US005737835A

United States Patent [19]

Murata

[11] Patent Number: 5,737,835

[45] Date of Patent: Apr. 14, 1998

[54] METHOD AND APPARATUS FOR MANUFACTURING A WIRE CRIMPING RECEPTACLE CONNECTOR

[75] Inventor: Osamu Murata, Shizuoka, Japan

[73] Assignee: Murata Kogyo Kabushiki Kaisha, Shizuoka, Japan

[21] Appl. No.: 545,585

[22] PCT Filed: Mar. 24, 1995

[86] PCT No.: PCT/JP95/00546

§ 371 Date: Nov. 3, 1995

§ 102(e) Date: Nov. 3, 1995

[87] PCT Pub. No.: WO95/26583

PCT Pub. Date: Oct. 5, 1995

[30] Foreign Application Priority Data

Mar. 28, 1994 [JP] Japan ..... 6-79240
Feb. 1, 1995 [JP] Japan ..... 7-34733

[51] Int. Cl.[6] ..... H01R 43/04

[52] U.S. Cl. ..... 29/863; 29/749; 29/564.4; 29/33 M

[58] Field of Search ..... 29/863, 749, 755, 29/564.1, 564.6, 748, 564.3, 564.4, 33 M; 439/748, 885; 72/413, 446, 712; 7/107

[56] References Cited

U.S. PATENT DOCUMENTS 4,214,361 7/1980 Coldren et al. ..... 29/863
4,419,817 12/1983 Funcik et al. ..... 29/564.6
5,127,159 7/1992 Kudo et al. ..... 29/863
5,365,659 11/1994 Ueda et al. ..... 29/749 X

FOREIGN PATENT DOCUMENTS 60-49511 3/1985 Japan .
60-211787 10/1985 Japan .
63-93087 6/1988 Japan .
63-117088 7/1988 Japan .
6-68946 3/1994 Japan ..... 29/863
6-84578 3/1994 Japan ..... 29/863

*Primary Examiner*—Peter Vo
*Assistant Examiner*—Khan Nguyen
*Attorney, Agent, or Firm*—Kubovcik & Kubovcik

[57] ABSTRACT

A method and apparatus for manufacturing a receptacle connector having contacts or terminals to which the wires are crimped includes a contact holder. The contact holder supports the contacts and wires gripped by the contacts. The advance movement of the contacts as retained in the contact holder makes it possible to insert the contacts into holes of a housing simultaneously and after that the wires are extracted from the contact holder. The wire crimped connector can be produced in a cycle time much shorter than a conventional process.

8 Claims, 8 Drawing Sheets

METHOD AND APPARATUS FOR MANUFACTURING A WIRE CRIMPING RECEPTACLE CONNECTOR

TECHNICAL FIELD

This invention relates to a method and apparatus for manufacturing a wire crimping receptacle connector or wire harness wherein the electric conductive contacts are crimped into the housing's cavities.

BACKGROUND ART

A receptacle connector or wire harness constructed by electric conductive contacts each crimping an end of a wire core and a housing with a single row of the crimped contacts finds wide use in a variety of electrical and electronic devices.

Each housing of the receptacle connector into which a plurality of contacts has been inserted generally is produced by molding a synthetic resin. As exemplified in FIG. 7, a housing 1 is formed to have a plurality of mounting holes or cavities 2 into which electric conductive contacts are inserted at right angles to the longitudinal direction in order to be coupled to the housing. The mounting holes or cavities 2 are formed as through-holes into which the coupling pins of a mating connector are inserted so as to couple with the contacts or terminals of the first-mentioned connector. The housing 1 is provided with locking portions, which utilize the resilience of a resin, so that the inserted contacts or terminals will not fall out.

As shown in FIG. 8, a contact terminal 4 usually is formed by punching and bending work so as to project from the side edge of a thin metal carrier 5. In the example of FIG. 8, the forward half of the conventional contact 4 is formed to have a tubular engaging portion 6 the outer side of which is fitted into the mounting hole or cavity 2 of the housing 1. The inner side of each engaging portion 6 mates with a pin of the other connector. The rearward half of the terminal 4 is formed to have a V-shaped wire barrel portion 7. The recess of the barrel portion 7 receives the tip of a wire from which the wire insulation has been stripped off. The contact or terminal 4 can be crimped to the wire by being squeezed strongly from above and below. In spite of the tubular porion 6, the V-shaped portion can be used.

The contacts 4 are formed at a regular pitch along the side edge of the metal carrier 5. The spacing of the contacts 4 is considerably larger than that of the mounting holes or cavities 2 of the housing 1 owing to the expanded shape of the material necessary in order to form the engaging portions 6 and wire barrel portions 7 of the terminals.

The conventional receptacle connector is fabricated by cutting off the contacts 4, which have been formed along the side edge of the metal carrier 5, one at a time, crimping the wire cores to the contacts one at a time and then inserting the contacts, to which the wires have been connected, into the mounting holes or cavities 2 of the housing of the connector. With this conventional manufacturing method of cutting off the contacts, crimping the wire cores and inserting the contacts into the housing of the connector one at a time, production is limited to 60 wires per minute. Accordingly, in the case of a harness composed of a large number of wires, manufacture requires a great deal of time. The result is higher cost.

DISCLOSURE OF INVENTION

Accordingly, an object of the present invention is to provide a method and apparatus for manufacturing a wire crimping receptacle connector in which the cycle time for crimping the wires to contacts and inserting the contacts into the housing is shortened over that of the conventional manufacturing method.

According to the present invention, the foregoing object is attained by providing a method of manufacuring a wire crimping receptacle connector wherein contacts or terminals formed along a side edge of a metal carrier are severed from the metal carrier, end portions of cores of wires are gripped or crimped to respective ones of the severed contacts and the contacts are inserted into respective ones of mounting holes or cavities of a housing to couple them to the housing, the method comprising the steps of (a) severing a contact from the metal carrier, (b) inserting a distal end of the severed contact into a corresponding holder hole of a contact holder so that the distal end is retained in the hole, (c) repeating the steps (a) and (b) a number of times equivalent to the number of wires to be connected to one connector, and placing exposed portions (outer insulation stripping conductor portions) of cores of the wires, which are located at the tips thereof, in wire barrel portions of the respective contacts retained in the holder holes of the contact holder, (d) simultaneously crimping respective ones of the wire cores placed in the wire barrel portions of the contacts to all of the contacts retained in the contact holder, (e) simultaneously extracting all of the contacts crimping the respective wires out of the contact holder, and (f) simultaneously inserting all of the contacts in respective ones of the mounting holes or cavities of the housing to couple them to the housing.

Further, according to the present invention, there is provided an apparatus for manufacturing a wire crimping receptacle connector including at least a contact holder with holes for inserting contacts thereinto, said contact holder being slidable successively along a guide rail means to a first position wherein the contacts are inserted into the holes of the contact holder, a second position wherein the wires are crimped to the contacts, and a third position wherein the contacts retained in the contact holder and to which the wires are crimped are inserted simultaneously into holes of a housing of the receptacle connector and the contact holder is separated from the wire.

According to the present invention, a prescribed number of contacts severed from the metal carrier are inserted into the holder holes of the contact holder, after which the exposed portions (cores) of the wires at the tips thereof are placed in the wire barrel portions of the respective contacts and the wire barrel portions of all of the contacts are squeezed. As a result, all of the contacts crimp the wires at one time. This is followed by pulling all of the contacts out of the contact holder simultaneously and inserting all of the contacts into the mounting holes or cavities of the housing simultaneously. This makes it possible to crimp the wires to the contacts and to insert the contacts to the housing in a cycle time that is much shorter than that of the prior art.

Other features and advantages of the present invention will be apparent from the following description taken in conjunction with the accompanying drawings, in which like reference characters designate the same or similar parts throughout the figures thereof.

BEST MODE FOR CARRYING OUT THE INVENTION

An embodiment of the present invention will now be described in detail with reference to the drawings.

Figure 1:
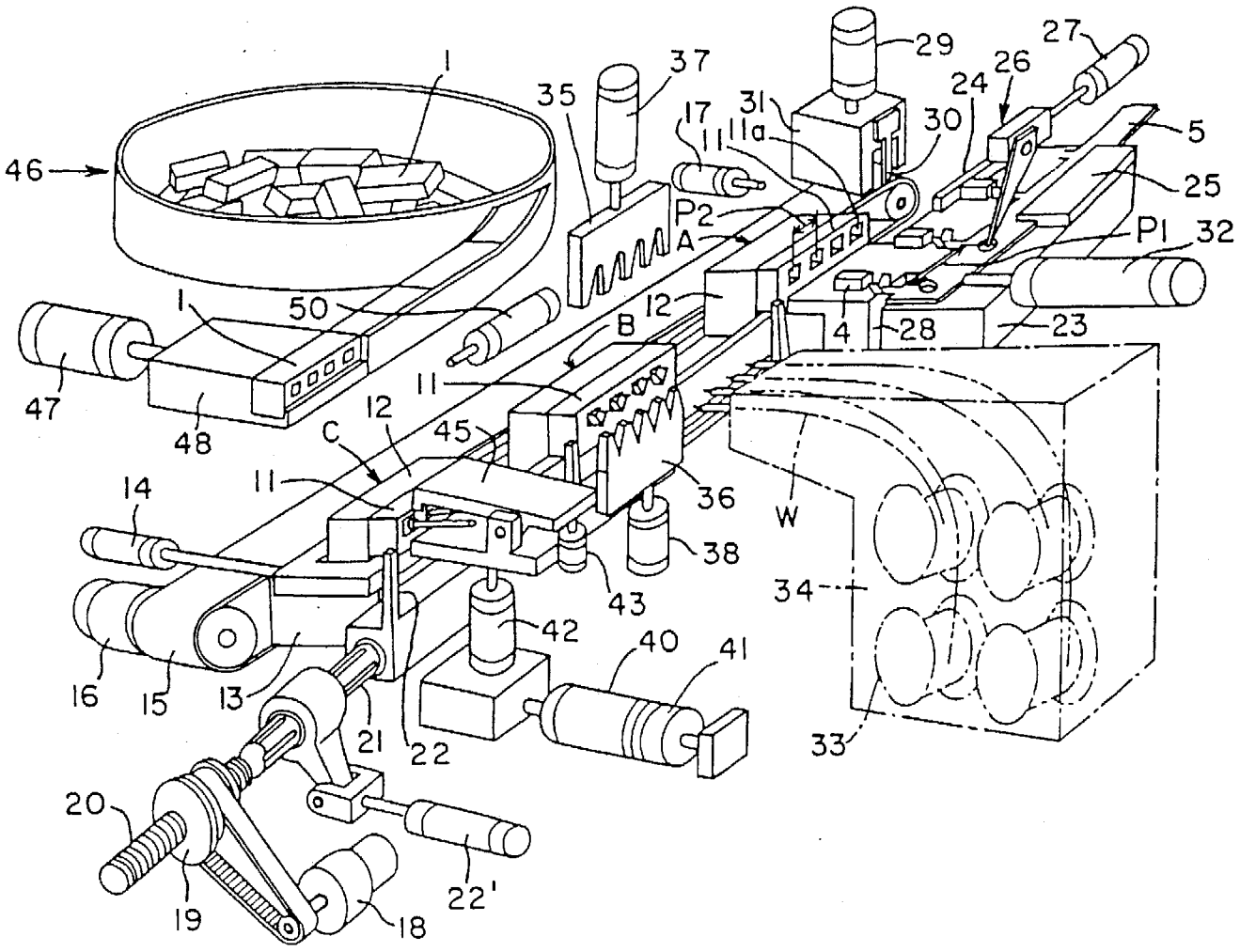
FIG. 1 is a perspective view illustrating an example of an apparatus suitable for practicing the manufacturing method of the present invention.
Figure 7:
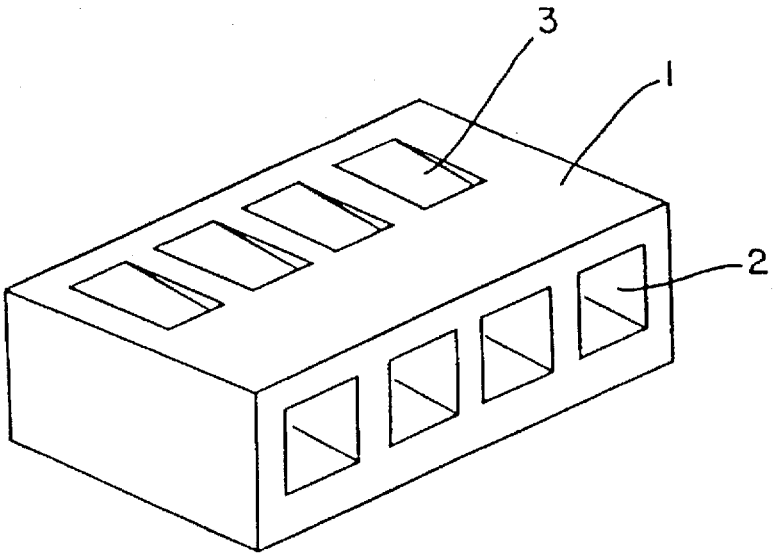
FIG. 7 is a perspective view illustrating an example of a housing as used in a wire crimping harness according to the present invention.

FIG. 1 is a perspective view illustrating an example of an apparatus suitable for practicing the manufacturing method of the present invention. The apparatus uses a contact holder 11 as a jig for attaching the contacts, described above with reference to FIG. 8, to the housing 1 exemplified in FIG. 7. The contact holder 11, which is made of metal, has holder holes 11*a* into which the contacts 4 are inserted so as to be held thereby. The holder holes 11*a* are provided at the same pitch as the pitch P2 of the mounting holes in the housing 1, and the number thereof is equal to that of the mounting holes or cavities. The contact holder 11 is attached to a holder jig 12 in a freely attachable and detachable manner.

The holder jig 12 carrying the contact holder 11 is moved along a guide 13 to three machining positions indicated at A, B and C in FIG. 1. After machining operations, described in detail later, have been performed at each of the three positions, the holder jig 12 is placed upon a return conveyor 15, which extends parallel to the guide 13, by a cylinder 14. The return conveyor 15 is driven by a motor 16, whereby the holder jig 12 is returned to the position corresponding to A. Here the holder jig 12 is placed upon the guide 13 again by a cylinder 17.

To avoid complicating the drawing and to facilitate an understanding of the invention, some holding devices and guides for moving the contact holder 11 and other parts are deleted from the drawing. In addition, the positions and shapes of some components such as the cylinders are illustrated differently than in actuality in order to make them easier to see.

As for the movement of the contact holder 11 connected to the holder jig 12 placed upon the guide 13, a servomotor 18 is driven in accordance with a program created beforehand in conformity with the machining steps. A screw rod 20 meshing with a nut 19 rotated by the servomotor 18 is moved in the thrust direction by the nut 19, whereby a contact holder feed pawl 22 coupled to the screw rod 20 via a spline 21 is moved in the longitudinal direction. The spline 21 is rotated about its axis by a cylinder 22', whereby the contact holder feed pawl 22 is turned about its axis so as to be erected or reclined, thereby engaging with and disengaging from the contact holder 11.

The machining position A is provided with a base 23 disposed at the side of the guide 13 and lying parallel thereto. The metal carrier 5 having the contacts 4 formed along the side edge thereof at a pitch P1 is placed upon the base 23, which is for feeding the metal carrier 5 in the longitudinal direction. Attached to the top side of the base 23 are guides 24, 25 for guiding the tips of a group of contacts 4 and the edge of the metal carrier 5 on the side thereof opposite to the contacts. Provided above the base 23 is a contact feeding device 26 operated by a cylinder 27 for feeding the metal carrier 5 incrementally at the contact pitch P1 by engaging holes formed in the metal carrier 5 at the same pitch P1 as that of the contacts 4. The base 23 is provided with a slit 28 at a location corresponding to the portion where the contacts 4 are connected to the metal carrier 5. The slit 28 is situated at a contact stopping position at a forward end in the feed direction. A contact cutting blade 30 raised and lowered by a cylinder 29 is provided directly above the slit 28. A contact holder 31 having a guide groove for limiting the positions of the side face and top face of the V-shaped barrel on the tubular portion of a contact is provided as an integral part of the cutting blade 30.

Figure 8:
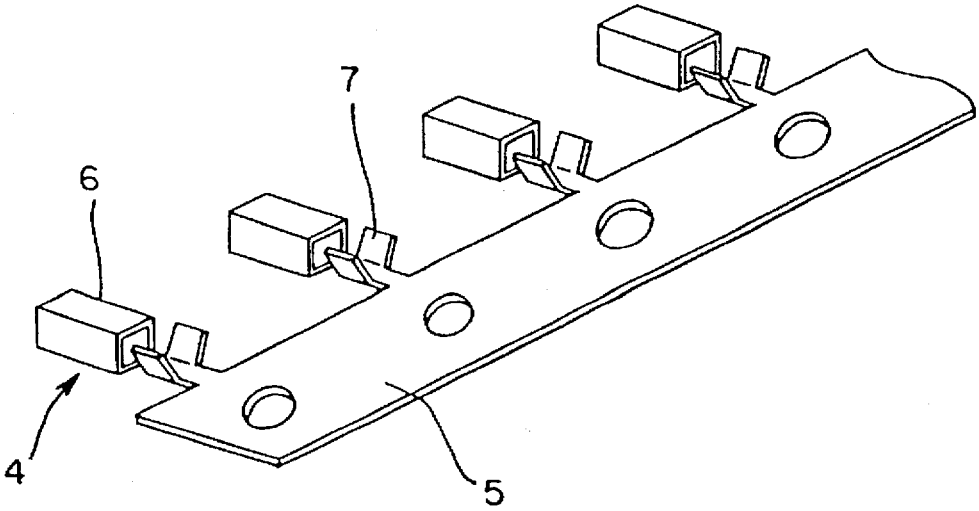
FIG. 8 is a perspective view illustrating an example of terminals or contacts formed on a side edge of a metal carrier.

As will be evident from FIG. 8, the contact 4 often has a V-shaped configuration. In the case of a V-shaped contact, there are occasions on which the upper edges of mutually adjacent contacts 4 come into contact, depending upon the pitch P1. Consequently, in a state in which the contacts 4 have been attached to the metal carrier 5, or when the contacts 4 are severed from the metal carrier 5, the contacts 4 are deformed from a V-shaped to U-shaped configuration. To accomplish this, each contact 4 is forced into a U-shaped groove of a die by a punch whose tip has an arcuate surface.

The metal carrier 5 having the contacts 4 formed thereon and the contact holder 11 are fed synchronously by the servomotor 18 and cylinder 27 in such a manner that the contacts 4 and holder holes 11*a* will be brought to a temporary stop successively at a fixed position corresponding to them. The contacts 4 are cut off by the cutting blade 30 at this position. The slit 28 provided in the base 23 functions as a relief for the cutting blade 30. A cylinder 32 equipped with a push rod is provided at the side of the base 23 at a position corresponding to a severed contact 4 in order to push the contact out from the rear and insert it into the holder hole 11*a* of the contact holder 11. In accordance with the operation of the apparatus described above, the contacts 4 are severed from the metal carrier 5 successively one at a time and the end portions of the contacts are inserted into the holder hole 11*a* of the terminal holder 11 one at a time. At this time the V-shaped wire and insulation barrel portions are in a state in which it protrudes outwardly from the holder hole 11*a*.

When the contacts 4 are inserted into all of the holder holes 11*a* of the contact holder 11, they are moved to position B, along with the contact holder 11 and holder jig 12, by the device comprising the feed pawl 22 and servomotor 18. A wire supply device 34 having wire bobbins 33, the number of which corresponds to the prescribed number of wires, each comprising an electric conductive core and an insulation overcoated therearound and a device for cutting the wires, stripping insulation thereoff and measuring lengths of the wires is provided at the side of position B. The wire supply device 34 dispenses wires W to be crimped to the contacts 4 held by the holder holes 11*a* of the contact holder 11 and places the tips of the cores of the wires, from which the insulation or covering has been stripped off, in the V-shaped recesses of the wire barrel portions of the contacts.

A crimper 35 and an anvil 36, which are provided above this portion, respectively, are driven by respective cylinders 37, 38, whereby the V-shaped wire and insulation barrel portions of all contacts are squeezed simultaneously to crimp the wires to the respective contacts. The wires are cut off to the prescribed lengths.

Next, the contact holder 11 is advanced to the position C. Provided at the side of this position is a clamper 45 advanced and retracted in two stages by cylinder 40, 41, raised and lowered by a cylinder 42 and closed and opened by a cylinder 43. As a result of these operations, the contacts 4 to which the wires have been crimped, and which are held by the contact holder 11, are all grasped simultaneously. By retracting the clamper 45, the contacts can be pulled free of the contact holder 11 simultaneously. The contact holder 11 from which the contacts have thus been extracted is placed upon the return conveyor 15 by the cylinder 14, and the conveyor 15 returns the contact holder 11 to the position A.

Connector housings 1 are pooled in a housing supplier 46 located above the guide 13 at position C from which the contact holder 11 has been removed. The housing 1 from the supplier 46 is supplied by a housing feed device 48, which is actuated by a cylinder 47, and is placed upon the guide 13 at a prescribed position. By advancing the clamper 45 using the cylinders 40, 41, all of the contacts to which the wires have been crimped, and which are being grasped by the clamper 45, are inserted into the mounting holes of the housing 1 simultaneously. The contacts are fitted into the mounting holes in such a manner that they will not be pulled off. Next, the clamper 45 is opened by the cylinder 43 and the clamper is retracted to distance it from the housing 1. The housing 1 fitted with the contacts to which the wires have been crimped is shifted onto the return conveyor 15 by the cylinder 14 and is discharged from the apparatus by a cylinder 50.

By replacing the wire feed device 34 by one having a somewhat different construction, new contacts can be crimped to free ends of the group of wires having the housings connected to their other ends so as to connect these ends to the housing.

The group of wires both of whose ends have thus been connected to housings is bundled together, a shielding material is wrapped around them and a vinyl sheath is continuously molded on the shielding, thereby producing a wire crimped connector.

In the embodiment described above, an example is illustrated in which the engagement portions of the contacts are tubularly shaped, the wire barrel portions are V-shaped and the contact mounting portions of the housing are made square holes. However, the shape of the holes is not limited to that of the foregoing embodiment; holes of any shape may be used.

An example illustrated in FIG. 2 has a basic construction similar to that illustrated in FIG. 1 so that the detailed description of the basic construction will be omitted by showing corresponding parts by the same reference characters and the improved construction will be described. In this embodiment, contacts 4 which have a pair of V-shaped barrel portions arranged in series for crimping electric conductive cores of the wires (W) and insulations molded on the cores and the contact holder 11 which has top or upwardly opened openings are used.

Figure 2:
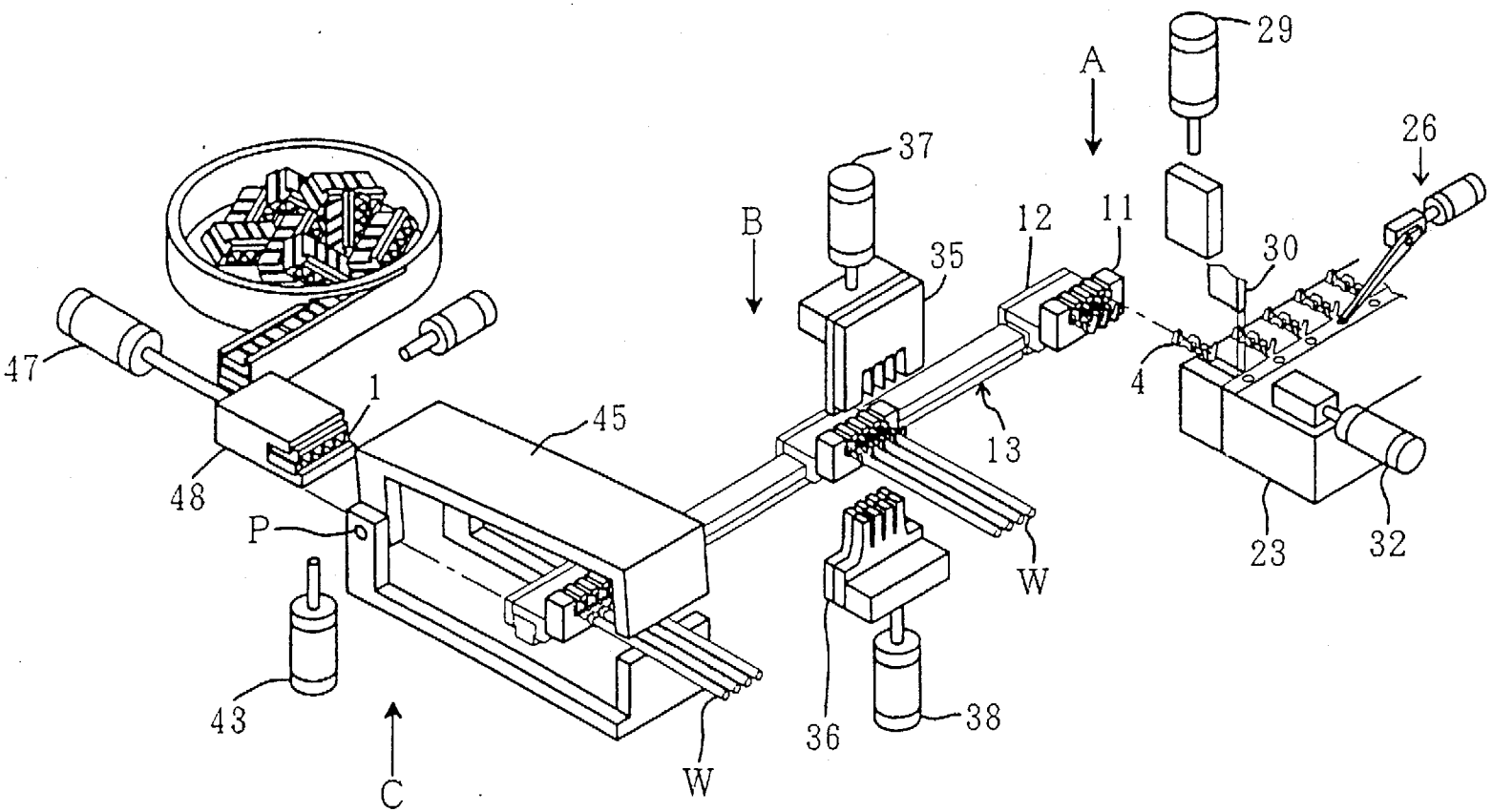
FIG. 2 is a perspective view illustrating another example of an apparatus suitable for practicing the manufacturing method of the present invention.

In the embodiment of FIG. 2, the holder jig 12 has a guide groove in which the guide rail 13 is accommodated so as to be slidable therealong. A mechanism for sliding the holder jig 12 will be described hereinafter with respect to FIG. 3. The contacts 4 which are severed at the position A and inserted into the holes of the contact holder are fed by the holder jig 12 to the position B, along with the contact holder 11. At this position the wire cores and the wire insulation are crimped to corresponding barrel portions of the contacts 4 by means of the crimper 35 and the anvil 36.

The contact holder 11 by which the contacts 4 crimping the wires are supported is transferred to the position C. The clamper 45 having a pivot point (P) at the side of the housing supply member grasps the wires in response to the movement of the cylinder 43. At this stage, the housing feed device 48 supporting the housing 1 in advanced by the cylinder 47 to insert the contacts 4 into the holes of the housing 1 to the extent of a prescribed length. Tongues 3 (shown in FIG. 7) formed on the housing are brought into contact with the inserted contacts 4, respectively to keep the contact at the desired position.

Figure 3:
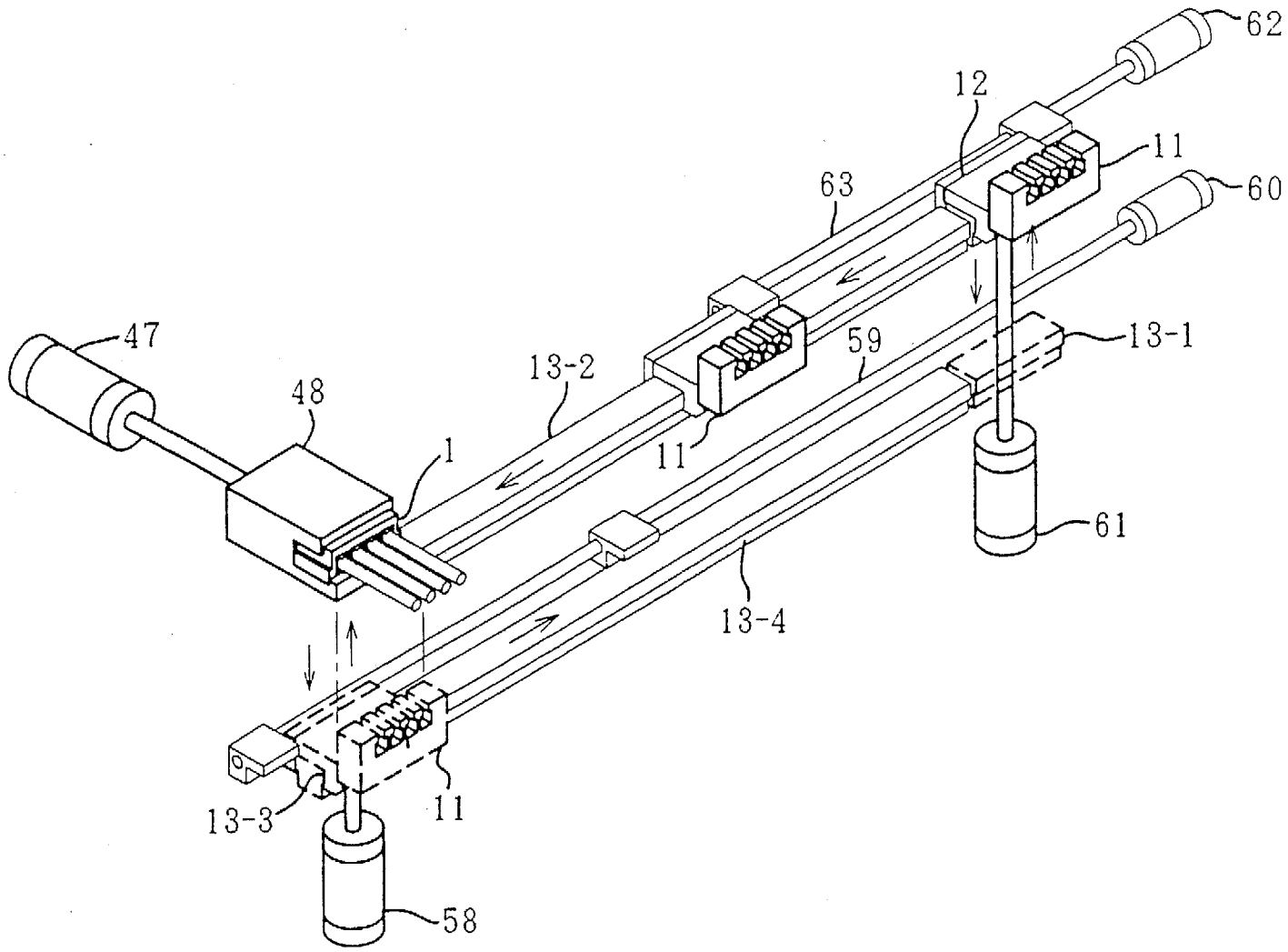
FIG. 3 is a perspective view illustrating a contact holder circulating path.

As shown in FIG. 3, the guide rail 13 is composed of a front portion 13-1 of short length, a central main portion 13-2 and a rear portion 13-3 of short length. The front portion 13-1 and the rear portion 13-3 are reciprocated between the level of the main portion (13-2) and the level of a return rail 13-4 which is located below the main portion 13-2. When the contacts 4 are inserted into the holes of the housing 1, the cylinder 58 causes the rear portion 13-3 to be moved downwardly to a level flush with that of the return rail 13-4 to make a successive path. At this time, since the wires (W) are supported by the crimper 35, the wires (W) are extracted from the top openings of the contact holder 11 and the rear portion 13-3 is lowered along with the holder jig 12 and the contact holder 11. Thus, a completed receptacle connector is released from the contact holder 11 and transferred to a prescribed position.

The contact holder 11 and the holder jig 12 are fed to a front area of the return rail 13-4 by a rod 59 and a cylinder 60. The cylinder 61 returns the contact holder 11 and the holder jig 12 to an initial position of which level is the same level of the main portion 13-2. The holder jig 12 and the contact holder 11 are advanced successively to positions A, B and C.

Figure 4:
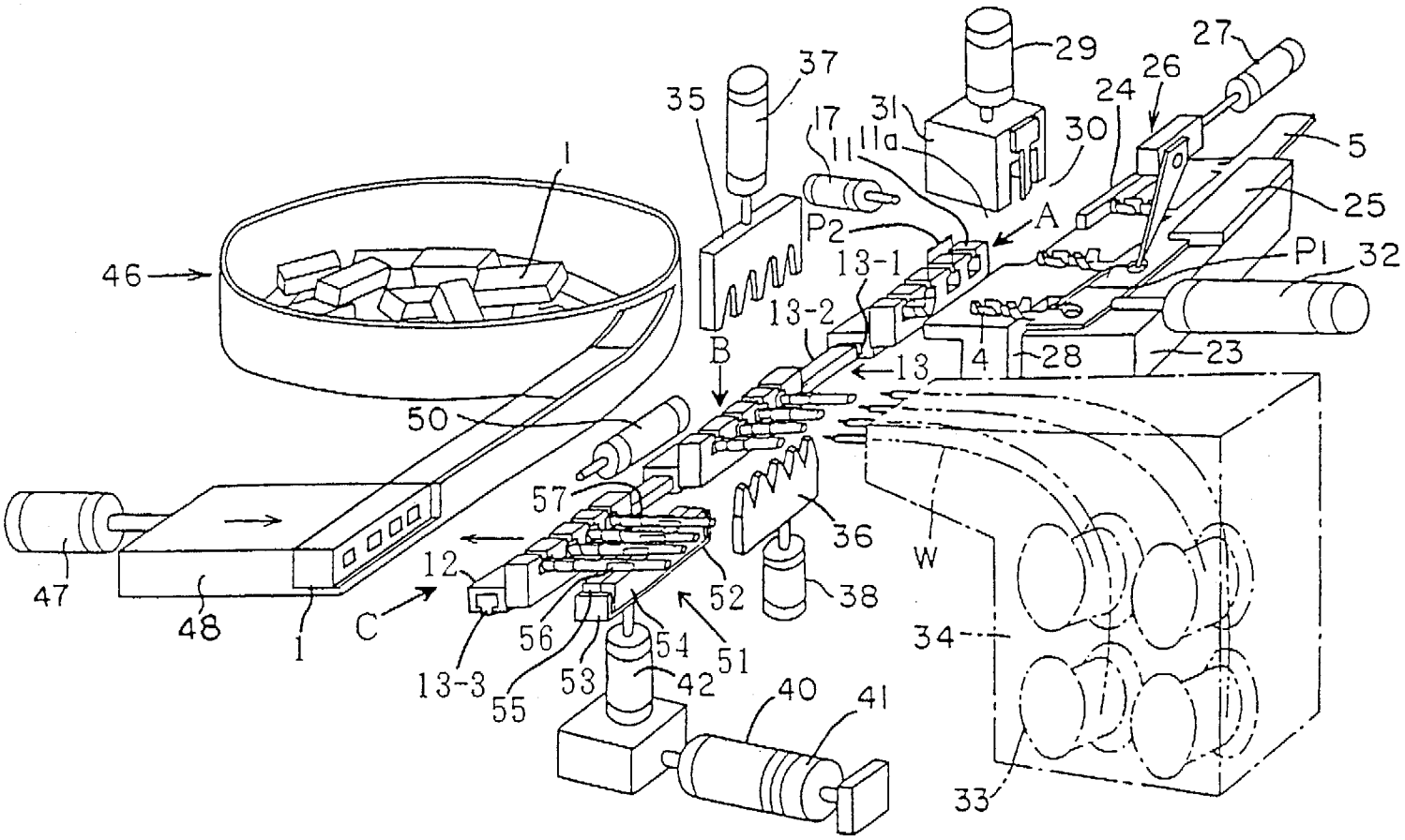
FIG. 4 is a modification of the example illustrated in FIG. 1.

An improved example of the clamper 45 illustrated in FIG. 2 is shown in FIG. 4 wherein the basic construction therein is similar to that described with reference to FIG. 2 so that the explanation thereof will be omitted. An improved clamper 51 has a pair of blocks 54, 55 slidable between side segments 53, 53 of a base 52 in the channel shape. Each block 54, 55 has a plurality of grasp segments 56, 57, respectively, which are spaced away from each other. Both the grasp segments 56, 57 grasp the wires (W) by approaching the grasp segments 56, 56 . . . to the other segments 57, 57 . . . by movement of each block 54, 55 in the directions of the arrows (shown in FIG. 5).

The wires (W) to which the contacts 4 are crimped at the position B are moved to the position C together with the contact holder 11 and inserted between each grasp segment 56, 57 of each block 54, 55 as the result of upward movement of the base 52 by actuation of the cylinder 42. Each block 54, 55 is moved by an actuator not shown in the directions of the arrows. The housing 1 supported by the housing feed device 48 is advanced by the cylinder 47 to insert the contacts 4 into the holes of the housing 1. After that, the rear portion 13-3 of the guide rail 13 is returned to the return rail 13-4 as described above.

Figure 5:
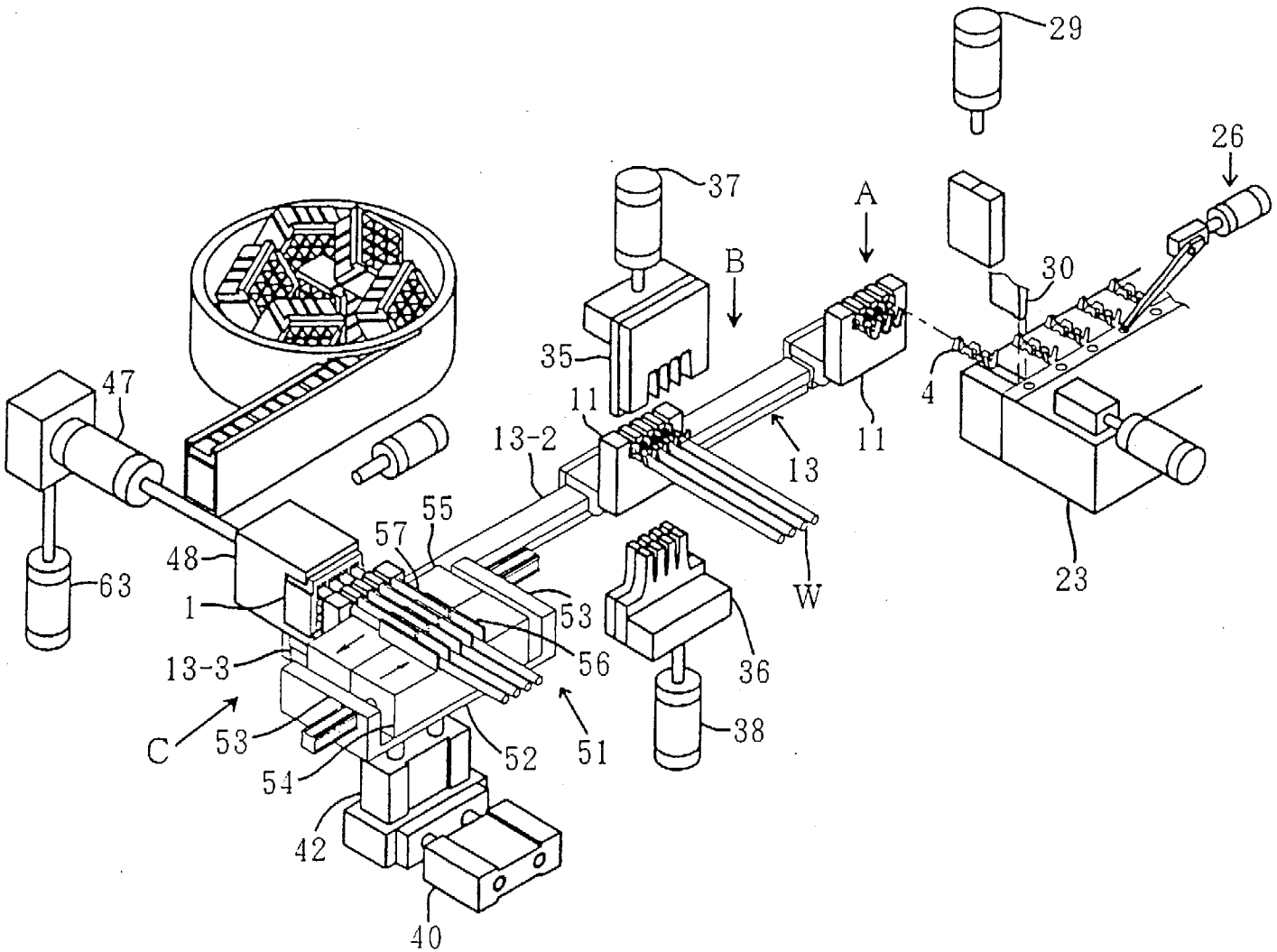
FIG. 5 is a perspective view an example as to how to insert contacts into housing's holes.

An example as illustrated in FIG. 5 uses a new housing 1 which has multi-stage holes for insertion of the contacts 4. The other construction is the same as that of FIGS. 1, 2, 3, or 4 and the description thereof will be omitted.

The wires (W) to which the contacts 4 are crimped or squeezed at the position B is fed to the position C wherein the clamper 51 grasps the wires (W) as described with reference to FIG. 4 and the housing 1 is advanced to insert the contacts 4 into the upper stage holes of the housing 1. By the measure shown in FIG. 3 the rear portion 13-3 of the rail 13 is lowered to the return rail 13-4. The wires following the wires as retained in the housing are grasped by the clamper 51 and the cylinder 63 causes the housing 1 to be raised so that the level of the wires (W) is the same level as that of the middle stage holes of the housing 1 and advance of the housing 1 makes it possible to insert the contacts to which the wires are crimped into the middle stage holes of the housing 1. By repetition of this process, the contacts to which the wires are crimped are inserted into the lower stage holes of the housing 1. Thus, the cycle time for insertion of contacts into the multi stage holes of the housing becomes shorter.

Figure 6:
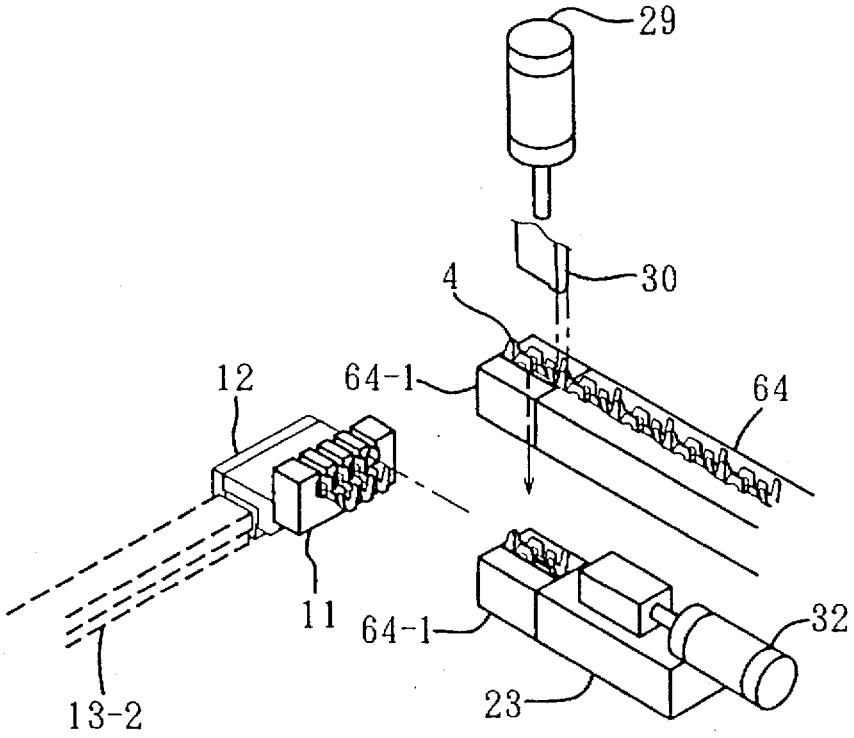
FIG. 6 is a perspective view illustrating contacts which are directly connected to each other without a carrier.

In the embodiments described with reference to FIGS. 1–5, the contacts 4 are integrally formed on the metal carrier 5. However, the contacts 4 in the shape which is illustrated in FIG. 6 will also be used in the present application. In this case, the contacts 4 formed in series without a carrier are linearly located in the central groove of a supplier 64 and one contact is cut off by the cutter 30. A front portion 64-1 of the supplier 64 which receives the severed contact 4 is lowered to the level of the base 23 and actuation of the cylinder 32 causes the contact 4 to be inserted into the holes of the holder 11 successively.

Figure 9:
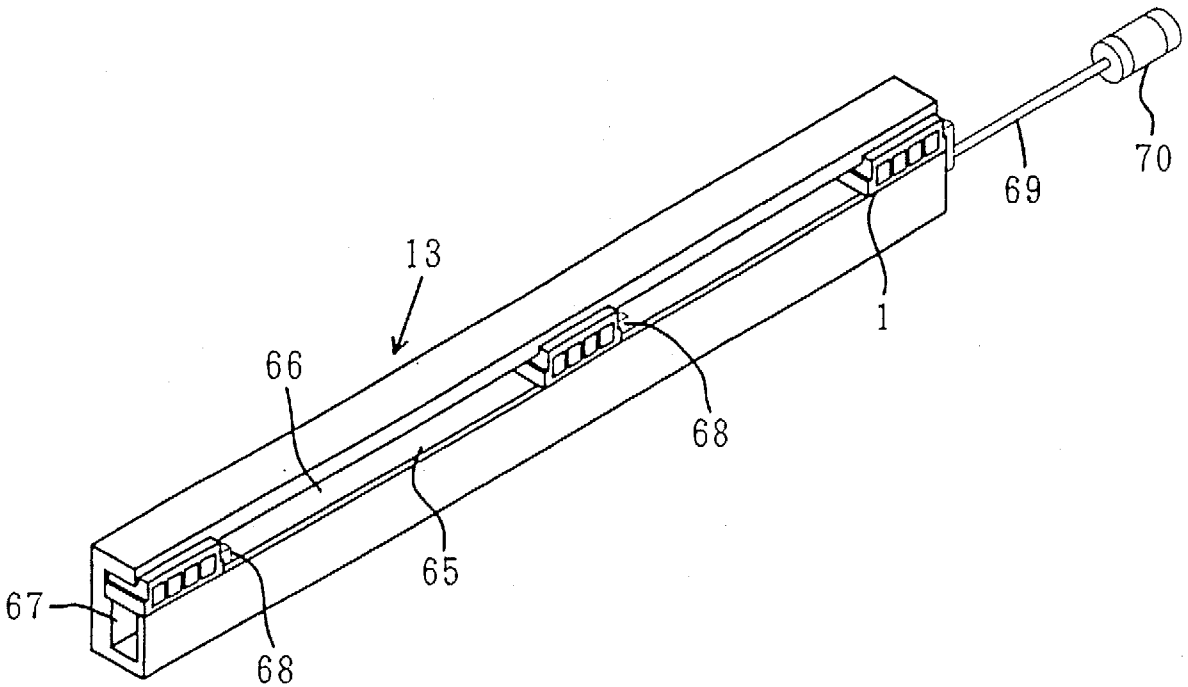
FIG. 9 is a perspective view illustrating a guide rail for moving housings.

A guide rail 13 as shown in FIG. 9 can be used in the present invention. The guide rail 13 has a window 65 exposing a front portion of the housing 1 and a groove 66 suitable to feed the housing 1. A space 67 in the guide rail 13 is in communication with the groove 66 and receives pawls 68 for feeding the housing 1 which are integral with a rod 69. The pawls 68 are reciprocated by the cylinder 70 along with the rod 69 so that the housing 1 is fed to positions A, B and C successively. The rotation of the rod 69 makes it possible to engage the pawls 68 with the housing 1 or disengage the pawls 68 from the housing 1.

INDUSTRIAL APPLICABILITY

Thus, in accordance with the present invention as described above, the crimping of the contact to the wires, the extraction of the contacts from the contact holder and the fitting of the contacts in the housing are performed simultaneously for all contacts. As a result, a wire crimped connector can be produced in a cycle time much shorter than that of the prior art, in which the foregoing operations are performed one wire at a time. This makes possible a major reduction in manufacturing cost.

As many apparently widely different embodiments of the present invention can be made without departing from the spirit and scope thereof, it is to be understood that the invention is not limited to the specific embodiments thereof except as defined in the appended claims.

I claim:

1. A method of manufacturing a wire crimping receptacle connector comprising a housing wherein contacts or terminals, each having a distal end and a wire barrel portion, formed along a side edge of a metal carrier are severed from the metal carrier, end core portions of wires are each gripped or crimped to respective ones of the severed contacts and the contacts are inserted into respective ones of mounting holes or cavities of the housing to couple them to the housing, the method comprising the steps of (a) severing a contact from the metal carrier, (b) inserting a distal end of the severed contact into a corresponding holder hole of a contact holder so that the distal end is retained in the holder hole, (c) repeating the steps (a) and (b) a number of times equivalent to the number of wires to be connected to the receptacle connector, and placing exposed core portions of the wires from which a coating of insulation has been stripped, which are located at the tips thereof, in wire barrel portions of the respective contacts which are retained in the holder holes of the contact holder, (d) simultaneously crimping respective ones of the exposed core portions placed in the wire barrel portions of the contacts to each of the contacts retained in the contact holder, (e) simultaneously removing all of the contacts crimping the respective wires from the contact holder, and (f) simultaneously inserting all of the contacts in respective ones of the mounting holes or cavities of the housing to couple them to the housing to thereby form the wire crimping receptacle connector.

2. A method of manufacturing a wire crimping receptacle connector comprising a housing, said method comprising the steps of:

providing electric conductive contacts having wire barrel portions and a contact holder having a plurality of holes therein;

inserting said contacts into holes of said contact holder;

crimping simultaneously at least tip ends of electric conductive wire cores of wires to said barrel portions of the contacts retained in the contact holder;

inserting simultaneously the contacts to which the wires are crimped and which are retained in the contact holder into holes of the housing by advancing them from the contact holder toward the housing to form the receptacle connector, wherein the wires are displaced into the contact holder; and separating the contact holder from the wires.

3. A method of manufacturing a wire crimping receptacle connector according to claim 2, wherein the step of inserting the contacts into holes of the contact holder is performed at a first position, the step of crimping is performed at a second position, and the step of inserting the contacts to which the wires are crimped into holes of the housing is performed at a third position.

4. A method of manufacturing a wire crimping receptacle connector according to claim 3, wherein the contact holder moves downwardly to separate the contact holder from the wires and is returned to the first position to insert the contacts into the holes of the contact holder.

5. An apparatus for manufacturing a wire crimping receptacle connector including at least a contact holder with holes for inserting contacts thereinto, said contact holder being slidable successively along a guide rail means to a first position wherein the contacts are inserted in the holes of the contact holder, a second position wherein the wires are crimped to the contacts, and a third position wherein the contacts, which are retained in the contact holder and to which the wires are crimped, are detached from the contact holder and inserted simultaneously into holes of a housing of the receptacle connector and the wires are displaced into the contact holder, and thereafter the contact holder is separated from the wires.

6. An apparatus for manufacturing a wire crimping receptacle connector according to claim 5, wherein the contact holder moves upwardly to the first position, the contact holder moves downwardly from the third position, and the contact holder is returned from the third position to the first position along a return rail.

7. An apparatus for manufacturing a wire crimping receptacle connector according to claim 5, further comprising a contact holder circulating means having a return rail means which is located in parallel with respect to the guide rail means, a holder supplying means for moving the contact holder from the return rail means to the first position, and a holder returning means for moving the contact holder from the third position to the return rail means.

8. An apparatus for manufacturing a wire crimping receptacle connector according to claim 5, wherein the contact holder has top openings through which the wires pass.

* * * * *